US007969078B2

(12) United States Patent
Lykowski

(10) Patent No.: US 7,969,078 B2
(45) Date of Patent: Jun. 28, 2011

(54) SPARK IGNITION DEVICE FOR AN INTERNAL COMBUSTION ENGINE AND SPARKING TIP THEREFOR

(75) Inventor: James Lykowski, Temperance, MI (US)

(73) Assignee: Federal Mogul Ignition Company, Southfield, MI (US)

( * ) Notice: Subject to any disclaimer, the term of this patent is extended or adjusted under 35 U.S.C. 154(b) by 239 days.

(21) Appl. No.: 12/467,528

(22) Filed: May 18, 2009

(65) Prior Publication Data

US 2009/0284117 A1 Nov. 19, 2009

Related U.S. Application Data

(60) Provisional application No. 61/054,215, filed on May 19, 2008.

(51) Int. Cl.
*H01T 13/39* (2006.01)
*H01T 13/20* (2006.01)

(52) U.S. Cl. ..... 313/141; 313/143

(58) Field of Classification Search ..... 313/118–145; 123/169 EL
See application file for complete search history.

(56) References Cited

U.S. PATENT DOCUMENTS

| | | | | |
|---|---|---|---|---|
| 4,400,643 | A | 8/1983 | Nishio et al. | |
| 4,414,483 | A | 11/1983 | Nishio et al. | |
| 4,427,915 | A | 1/1984 | Nishio et al. | |
| 4,786,267 | A | 11/1988 | Toya et al. | |
| 4,904,216 | A * | 2/1990 | Kagawa et al. | 445/7 |
| 5,557,158 | A | 9/1996 | Kanao et al. | |
| 6,132,277 | A | 10/2000 | Tribble et al. | |
| 6,188,166 | B1 | 2/2001 | Nishikawa et al. | |
| 6,583,537 | B1 | 6/2003 | Honda et al. | |
| 2005/0057133 | A1 | 3/2005 | Hori | |
| 2006/0028106 | A1 | 2/2006 | Lineton et al. | |
| 2006/0066194 | A1 | 3/2006 | Morin | |
| 2006/0082276 | A1 | 4/2006 | Havard et al. | |
| 2007/0236125 | A1 | 10/2007 | Lykowski et al. | |
| 2007/0290591 | A1 | 12/2007 | Lykowski et al. | |
| 2007/0290593 | A1 | 12/2007 | Kowalski | |
| 2008/0030116 | A1 | 2/2008 | Joseph et al. | |
| 2008/0050264 | A1 | 2/2008 | Lykowski et al. | |
| 2008/0295925 | A1 | 12/2008 | Manhardt et al. | |
| 2008/0308057 | A1 | 12/2008 | Lykowski et al. | |

FOREIGN PATENT DOCUMENTS

GB 2299813 A * 10/1996

* cited by examiner

*Primary Examiner* — Mariceli Santiago
(74) *Attorney, Agent, or Firm* — Robert L. Stearns; Dickinson Wright, PLLC

(57) ABSTRACT

A spark ignition device is provided having an electrode sparking tip constructed from an AuPd alloy with the addition of at least 3 wt. % of a precious metal element selected from at least one of platinum, iridium, rhodium and ruthenium. The gold counteracts oxidation of the palladium and the additional elements provide the sparking tip with high temperature and high strength mechanical properties and resistance to alloying with the combustion constituents during use.

20 Claims, 1 Drawing Sheet

FIG. 1
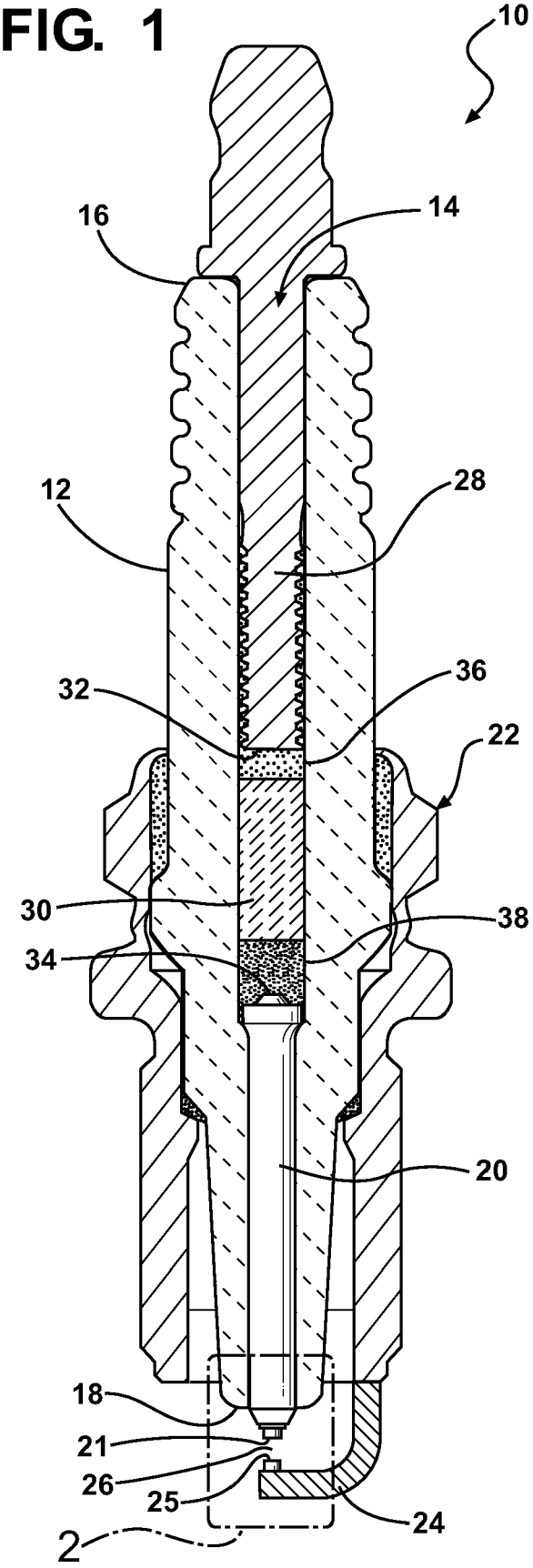
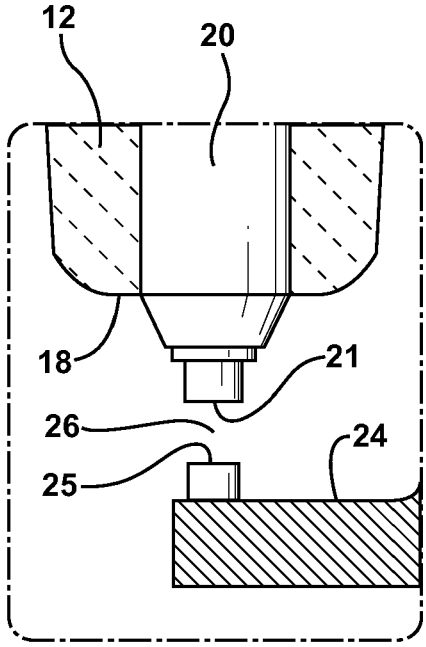
FIG. 2

SPARK IGNITION DEVICE FOR AN INTERNAL COMBUSTION ENGINE AND SPARKING TIP THEREFOR

CROSS-REFERENCE TO RELATED APPLICATION

This application claims the benefit of U.S. Provisional Application Ser. No. 61/054,215, filed May 19, 2008, which is incorporated herein by reference in its entirety.

BACKGROUND OF THE INVENTION

1. Technical Field

This invention relates generally to spark ignition devices, such as spark plugs for internal combustion engines, and more particularly to the alloys used to make the sparking surface of the sparking electrode of such devices.

2. Related Art

Various precious metal alloys are used for the sparking surfaces of spark plug electrodes. Some of the precious metal elements are less costly than others, but there is sometimes a trade-off in terms of the properties that can be achieved using the less costly alloy alternatives. For example, palladium is a relatively low cost element, however it has been found to oxidize in the operating environment of spark plug sparking surfaces. For example, the palladium used in sparking surfaces made from alloys of rhenium-palladium or platinum-palladium-iridium alloys has been shown to oxidizes during use.

It has been found that alloying gold with palladium has the beneficial effect of mitigating the oxidation of palladium under the operating environment of a spark plug electrode. However, known palladium-gold alloys (e.g., Au40Pd) have mechanical properties believed to be too soft and weak for extended use in modern sparking surface applications. Further, the known palladium-gold alloy materials are prone to alloy with the combustion constituents present in the operating environment, such as lead, thereby causing the material to degrade in use.

SUMMARY OF THE INVENTION

According to one aspect of the invention, a spark ignition device, such as a spark plug, is provided having an electrode sparking tip made from a AuPd alloy with the addition of a precious metal element of at least 3 wt. % selected from at least one of platinum, iridium, rhodium and ruthenium. The gold counteracts oxidation of the palladium and the additional element or elements provide high temperature mechanical properties and resistance to alloying with the combustion constituents during use.

According to another aspect of the invention, the Au makes up at least 10 wt. % of the sparking tip.

According to another aspect of the invention, the AuPd alloy makes up at least 40 wt. % of the sparking tip, with the additional precious metal element making up the difference.

According to yet another aspect of the invention, the above AuPd and Pt, Ir, Rh and/or Ru alloy can be diluted with a non-precious metal, such as Ni (up to about 30 wt. %), and further include the addition of small amounts of W (1-4 wt. %) for lowering work function, and optionally small amounts of one or more reactive elements, such as Zr, Y, La, Hf, Ta at 0.01-0.2 wt % for grain stabilization.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

FIG. 1 is a cross-sectional elevation view of an ignition device with an electrode sparking tip constructed in accordance with the invention; and FIG. 2 is an enlarged view of the encircled region 2 of FIG. 1.

DETAILED DESCRIPTION OF PRESENTLY PREFERRED EMBODIMENTS

Referring in more detail to the drawings, FIG. 1 illustrates a spark ignition device 10 constructed in accordance with one presently preferred aspect of the invention for use in igniting a fuel/air mixture in internal combustion engines. The exemplary spark ignition device 10 is illustrated in the form of a spark plug, but the invention contemplates other ignition devices to be within the scope of the claims, such as glow plugs, for example. The device 10 includes an annular ceramic insulator 12 fabricated of aluminum oxide or another suitable electrically insulating material in known manner. The insulator 12 has a central passage 14 extending longitudinally between an upper terminal end 16 and a lower nose or core end 18 in which a center electrode 20 is disposed. The center electrode 20 has a sparking surface, referred to hereafter as sparking tip 21, at a free end thereof. An electrically conductive metal shell 22 is disposed in sealed relation about the lower and mid portions of the insulator 12 and may be made from any suitable metal, such as various steel alloys, and may be coated with a Zn or Ni-base alloy coating or the like in known manner. The shell 22 includes at least one ground electrode 24 which may have any of a number of shapes, sizes and configurations, such as the standard single L-shaped configuration illustrated in the drawings, for example. The ground electrode 24 has at least one ground electrode sparking surface, referred to hereafter as sparking tip 25, that is spaced across a spark gap 26 from the sparking tip 21 of the center electrode 20. At least one of the sparking tips 21, 25 is constructed from AuPd alloy with the addition of at least one of platinum, iridium, rhodium and ruthenium of at least 3 wt. %. The gold counteracts oxidation of the palladium and the additional element adds the needed high temperature mechanical properties and resistance to alloying with the combustion constituents during use.

An electrically conductive terminal stud 28 is disposed in the central passage 14 of the insulator 12 with a free lower end 32 of the terminal stud 28 being disposed adjacent a resistor layer 30 which is arranged between the lower end 32 and an upper end 34 of the center electrode 20. Conductive glass seals 36, 38 separate the resistor layer 30 from the stud 28 and center electrode 20, respectively. This resistor layer 30 can be made from any suitable composition used in such applications to suppress electromagnetic interference (EMI). The terminal stud 28, upper glass seal 36, resistor layer 30, lower glass seal 38 and center electrode 20 provide an electrical path, whereas the shell 22 and ground electrode 24 provide a ground path spaced from the electrical path across the spark gap 26.

At least one or both of the sparking tips 21, 25 are constructed of a AuPd-based alloy, whereas the center electrode 20 and ground electrode 24 can be fabricated of a material other than that used to construct the sparking tips 21, 25. If both sparking tips 21, 25 are constructed of a AuPd-based alloy, they may be of the same or different AuPd-based alloy composition. As illustrated, the sparking tips 21, 25 are conductively joined, such as by welding, to the center and ground electrodes 20, 24, respectively. It should be recognized that the mechanism of attachment of the sparking tips 21, 25 may be performed utilizing any suitable mechanism of attachment, and further, that the shape of the sparking tips 21, 25 may by other than as described or shown, such as disc, cylinders, rivets, bars, or other shapes, as desired.

The AuPd-based alloy is prealloyed with at least one precious metal effective to increase the high temperature performance properties and increase the mechanical strength of the finished sparking tip material to levels suitable for modern sparking surface applications, as well as to prevent the AuPd constituents from further alloying and breaking down in the presence of common combustion constituents, such as lead. One such precious metal found to be effective in increasing the mechanical strength of the finished sparking tip material and in preventing or inhibiting unwanted alloying is platinum (Pt). Alloys of 55 wt. % Au, 40 wt. % Pd and 5 wt. % Pt; 50 wt. % Au, 30 wt. % Pd and 20 wt. % Pt; and 50 wt. % Au, 40 wt. % Pd and 10 wt. % Pt have proven to be effective as low cost sparking tip materials for spark plugs, while providing the desired mechanical strength and resistance to alloying in use. In general, the Pt can be added in ranges of 3-50 wt. %, 5-20 wt. % or 5-10 wt. % to an alloy of AuPd which is alloyed in a ratio of about 1.5:1, while AuPd alloyed ratios of 0.25:1 to 2:1 are also contemplated herein.

According to a further aspect of the invention, one or more additional precious metals may be added to the AuPd alloy, such as Ir, Rh and/or Ru either in combination with Pt or in place of Pt. For example, an alloy of 46 wt. % Pt, 34 wt. % Pd, 10 wt. % Au and 10 wt. % Ir has shown to be an effective alloy for sparking tips of spark plugs. According to yet a further aspect of the invention, these alloys can be diluted with non-precious metals, such as Ni and can include small amounts of W (1 to 4 wt. %) for lowering work function. In addition or alternatively, these alloys can be further alloyed with small amounts of one or more reactive elements, such as Zr, Y, La, Hf or Ta in amounts from 0.01-0.2 wt. % as a grain stabilizer for the alloy.

According to yet another aspect of the invention, the sparking tips 21, 25 can be fabricated of AuPd-based alloys having an Au content greater than 10 wt. % and a Pd content greater than 5 wt. % in combination with at least one of Pt, Ir, Rh or Ru. This material may be further alloyed with small amounts of W as discussed above, as well as optionally being alloyed with one or more reactive elements as discussed above.

Obviously, many modifications and variations of the present invention are possible in light of the above teachings. It is, therefore, to be understood that within the scope of the appended claims, the invention may be practiced otherwise than as specifically described. Accordingly, the invention is ultimately defined by the scope of any allowed claims, and not solely by the exemplary embodiments discussed above.

What is claimed is:

1. A spark ignition device, comprising:

a generally annular ceramic insulator;

a metal shell surrounding at least a portion of said ceramic insulator;

a ground electrode operatively attached to said shell;

a center electrode, said center electrode and said ground electrode providing a spark gap; and at least one of said ground electrode or said center electrode having a sparking tip constructed of AuPd alloy with the addition of at least 3 wt. % of at least one precious metal element selected from the group consisting of platinum, iridium, rhodium and ruthenium.

2. The spark ignition device of claim 1 wherein said Au makes up at least 10 wt. % of said at least one of said ground electrode sparking tip or said center electrode sparking tip.

3. The spark ignition device of claim 2 wherein the AuPd alloy makes up at least 40 wt. % of said sparking tip.

4. The spark ignition device of claim 3 wherein said at least one precious metal is provided as platinum making up the balance of said at least one of said ground electrode sparking tip or said center electrode sparking tip.

5. The spark ignition device of claim 3 wherein Au makes up at least 30 wt. % of said at least one of said ground electrode sparking tip or said center electrode sparking tip.

6. The spark ignition device of claim 5 wherein Au makes up at least 40 wt. % of said at least one of said ground electrode sparking tip or said center electrode sparking tip.

7. The spark ignition device of claim 5 wherein said at least one precious metal is provided as platinum making up the balance of said sparking tip.

8. The spark ignition device of claim 1 wherein said AuPd alloy and said at least one precious metal element is diluted with a non-precious metal.

9. The spark ignition device of claim 8 wherein said non-precious metal is provided at least in part as Ni.

10. The spark ignition device of claim 1 wherein said sparking tip further includes 1-4 wt. % W.

11. The spark ignition device of claim 1 wherein said sparking tip further includes at least one element selected from the group consisting of Zr, Y, La, Hf, and Ta.

12. A sparking tip for a spark ignition device, comprising:

a AuPd alloy with the addition of at least 3 wt. % of at least one precious metal element selected from the group consisting of platinum, iridium, rhodium and ruthenium.

13. The sparking tip of claim 12 wherein said Au makes up at least 10 wt. % of said sparking tip.

14. The sparking tip of claim 13 wherein the AuPd alloy makes up at least 50 wt. % of said sparking tip.

15. The sparking tip of claim 14 wherein said at least one precious metal is provided as platinum making up the balance of said sparking tip.

16. The sparking tip of claim 14 wherein Au makes up at least 30 wt. % of said sparking tip.

17. The sparking tip of claim 16 wherein Au makes up at least 50 wt. % of said sparking tip.

18. The sparking tip of claim 17 wherein said Pd makes up at least 30 wt. % of said sparking tip and said at least one precious metal is provided as platinum making up the balance of said sparking tip.

19. The sparking tip of claim 12 wherein said AuPd alloy and said at least one precious metal element is diluted with a non-precious metal.

20. The sparking tip of claim 19 wherein said non-precious metal is provided at least in part as Ni.

* * * * *